United States Patent [19]

Tanaka et al.

[11] Patent Number: 4,831,314

[45] Date of Patent: May 16, 1989

[54] DRIVE APPARATUS FOR OPENING AND CLOSING MECHANISM

[75] Inventors: Toshio Tanaka; Seiichi Sugai, both of Susono, Japan

[73] Assignee: Higashi Fuji Manufacturing Co., Ltd., Tokyo, Japan

[21] Appl. No.: 119,029

[22] Filed: Nov. 10, 1987

[30] Foreign Application Priority Data

Nov. 11, 1986 [JP] Japan ..... 61-172775[U]
Nov. 28, 1986 [JP] Japan ..... 61-183078[U]

[51] Int. Cl.[4] ..... E05F 15/10

[52] U.S. Cl. ..... 318/484; 318/452; 49/30

[58] Field of Search ..... 318/445, 452, 466, 467, 318/468, 484; 49/26, 27, 28, 29, 30; 192/0.02 R, 0.04, 0.048, 0.052, 0.07, 0.092

[56] References Cited

U.S. PATENT DOCUMENTS 3,247,615 4/1966 Kalog ..... 49/30
3,429,073 2/1969 Tucker ..... 49/30 X
3,733,747 5/1973 Fox et al. ..... 49/30
3,874,117 4/1975 Boehm ..... 49/30 X
4,289,995 9/1981 Sorber et al. ..... 318/9
4,605,107 8/1986 Hallidy et al. ..... 192/0.02 R
4,658,545 4/1987 Ingham et al. ..... 49/29 X

FOREIGN PATENT DOCUMENTS 2127894 4/1984 United Kingdom ..... 49/28

*Primary Examiner*—Bentsu Ro
*Attorney, Agent, or Firm*—Scully, Scott, Murphy & Presser

[57] ABSTRACT

A drive apparatus for an opening and closing mechanism includes an electric motor, a clutch, a reduction gear unit and a timer mechanism. The clutch includes a coupling having first and second halves engageable with each other, and an actuator mechanism for connecting and disconnecting the first and second halves. The first half of the coupling is operatively connected to a rotor of the motor. The reduction gear unit is operatively connected to the second half of the clutch. The reduction gear unit has an output shaft for being operably connected to the opening and closing mechanism. The timer mechanism is provided for regulating the operating period of time of the motor in response to the operation of the reduction gear unit.

9 Claims, 10 Drawing Sheets

DRIVE APPARATUS FOR OPENING AND CLOSING MECHANISM

BACKGROUND OF THE INVENTION

1. Field of the Invention

The present invention pertains to a drive apparatus for an opening and closing mechanism which is used in a ventilating system, a remote operated valve or the like.

2. Related Art

Conventional ventilating systems include shutters which are open during the operation of the systems. When the systems are not in operation, such shutters are closed to prevent wind and rain blowing into a room and to protect their fans, motors and the like of the systems.

To open and close such shutters, the following three methods have conventionally been practiced. First, the shutter as well as the fan motor may be operated interlockingly by manipulating a single pulling string. Secondly, the shutter may be opened by making use of wind pressure produced by, the fan and closed by its own weight when the fan stops. Thirdly, the shutter may be connected with the fan motor through a clutch mechanism or the like.

Among the above, the first method has drawbacks that a great force is required to manipulate the string, thus often causing difficulties to arise when operated by children or women. Besides, the place where the ventilation system may be located is comparatively limited due to the necessity of manipulating the string. In the second method, the force to be exerted on the shutter to open it is relatively small, and hence the shutter would not operate properly if a grease stain or the like has stuck to the system. Moreover, a strong outdoors wind may prevent the shutter from opening sufficiently, thus decreasing its ventilation capacity. In addition, such method cannot be applied to a ventilating system for introducing fresh air and expelling foul air.

Further, the third method requires a clutch which is responsive to the starting and stopping of the fan motor to transmit the rotational force of the fan motor to an opening and closing mechanism for the shutter. As such a clutch, a centrifugal clutch which makes use of centrifugal force of the rotation of the fan motor might be possibly employed. The clutch is, however intricate in construction, and susceptible to mechanical difficulties since the ventilating system may be easily soiled with grease, or the like. Furthermore, this method also cannot be used in a ventilating system employed both to introduce fresh air and expel foul air.

SUMMARY OF THE INVENTION

It is therefore an object of the present invention to provide a drive apparatus for use in an apparatus equipped with an opening and closing mechanism, and which is particularly adapted for a shutter operating mechanism of a ventilating system so as to operate a shutter independently of the operation of a fan motor.

According to the present invention, there is provided a drive apparatus for an opening and closing mechanism, comprising: an electric motor having a rotor; clutch means including a coupling having first and second halves engageable with each other, and actuator means for connecting and disconnecting the first and second halves, the first half of the coupling being connected to the rotor; reduction gear means operatively connected to the second half of the coupling of the clutch, the reduction gear means having an output shaft for being operatively connected to the opening and closing mechanism so as to rotate in different directions for the opening and closing operations of the mechanism; and timer means operable to regulate the operating period of time of the motor in response to the operation of the reduction gear means.

DESCRIPTION OF THE PREFERRED EMBODIMENTS OF THE INVENTION

Figure 1:
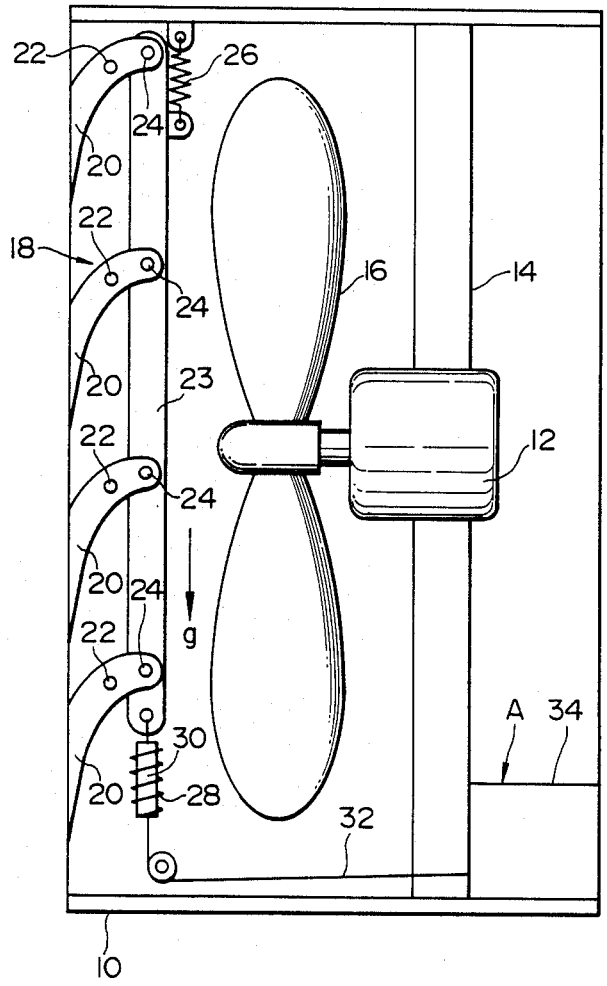
FIG. 1 is a side elevational view of a ventilating system to which a drive apparatus in accordance to the present invention is attached.
Figure 2:
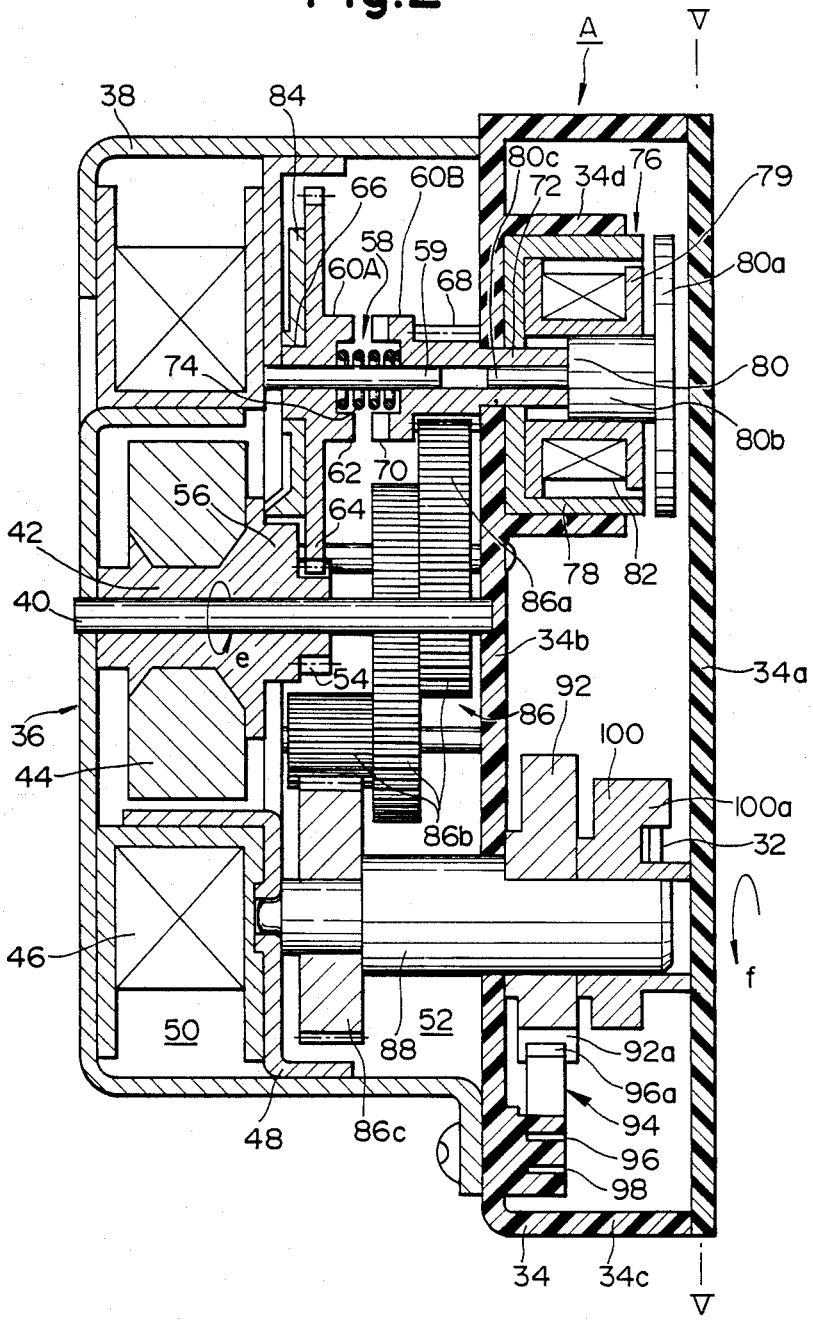
FIG. 2 is a cross-sectional view of the drive apparatus in accordance with the present invention.

Various embodiments of the present invention will now be described with reference to the accompanying drawings in which like reference characters denote corresponding parts in several views.

Referring now to FIGS. 1 to 6, a ventilating system includes a framework 10, a fan motor 12 attached to the framework 10 through a support 14, a fan 16 fixedly secured to an output shaft of the motor 12, and a shutter 18 disposed in front of the fan 16. The shutter 18 is comprised of a plurality of louvers or slats 20 each pivotally connected to the framework 10 through a pin 22 and a connecting lever 23 to which the one end of each louver 20 is pivotally connected through a pin 24. A coil spring 26, which is fixedly secured at its one end to the framework 10 through fitting, is connected at its opposite end to the upper end portion of the connecting lever 23 through a fitting so as to act between the framework 10 and the connecting lever 23 to urge the lever upwardly. Further, a buffer spring 28 disposed around a support 30 is secured at its one end to the lowermost end of the lever 23, and the opposite end of the spring 28 is connected to a drive apparatus A according to the present invention through a wire 32.

The drive apparatus A is disposed in the low and rear portion of the framework 10, and includes a casing 34 of a synthetic resin defined by front and rear walls 34*a* and 34*b* and side wall 34*c* joining the front and rear walls, and a drive synchronous motor 36 mounted on the casing 34. The electric motor 36 has a motor housing 38 having an open end fixedly secured to the outer surface of the rear wall 34*b* of the casing 34, a rotor shaft 40 fixedly secured at its one end to a wall of the housing 38 and at its other end to the rear wall of the casing 34, a rotor 42 of a circular cross-section rotatably mounted on the rotor shaft 40 and having an annular permanent magnet 44 mounted on the rotor 42 for rotation therewith, and a stator coil 46 disposed around the rotor 42 in opposed relation to the magnet 44. A partition wall 48 is provided in the housing 38 to define first and second compartments 50 and 52 therein, and the stator coil 46 as well as the magnet 44 is accommodated within the first compartment 50. The rotor 42 has an annular gear portion 54 formed at its one end and a pair of radially outwardly extending projections 56 formed adjacent to the gear portion 54 and disposed in diametrically opposite relation to each other. The rotor 42 extends through an aperture formed in the partition wall 48 so that the gear portion 54 and the projections 56 are disposed in the second compartment 52.

Connected to the rotor 42 of the motor 36 is a jaw clutch 58 which includes a coupling comprising first and second halves 60A and 60B housed in the second compartment 52. The clutch 58 has a shaft 59 fixedly secured at its one end to the partition wall 48, and the both halves 60A and 60B of the coupling are rotatably mounted thereon. In addition to an engagement end portion 62 disposed at one end, the first half 60A of the coupling has an exteriorly toothed disk gear portion 64 disposed adjacent to the end portion 62 and a hub portion 66 formed at its other end, the gear portion 64 meshing with the gear portion 54 of the rotor 42. The second coupling half 60B has an exteriorly toothed cylindrical gear portion 68 formed intermediate opposite ends thereof, an engagement end portion 70 formed at its one end so as to be engageable with the engagement portion 62 of the first half, and cylindrical hub portion 72 formed at its other end. The hub portion 72 has a smaller diameter than the gear portion 68 and extends through the rear wall 34*b* of the casing 34. The engagement end portions 62 and 70 include recesses formed in their end faces, respectively, and opposed to each other, and a coil spring 74 is disposed around the shaft 59 with its opposite ends accommodated in the recesses, respectively, and acts between the bottoms of the recesses to urge the second half 60B of the coupling away from the first half 60A. Attached to the other end of the second half 60B of the coupling is a solenoid 76 accommodated in the casing 34. The solenoid 76 comprises a cylindrical solenoid casing or stationary yoke 78 made of a magnetic material such as iron, a bobbin 79 accommodated in the solenoid casing 78, a slide member or mobile yoke 80 of a magnetic material disposed through the axial bore of the bobbin for longitudinal sliding movement, and a solenoid coil 82 wound around the bobbin 79. A cylindrical support 34*d* is integrally formed on the inner surface of the rear wall 34*b* of the casing 34, and the solenoid casing 78, which has a bottom with an aperture therethrough and an open top, is supported by and accommodated within the support 34*d* with its bottom held in contact with the rear wall 34*b* of the casing 34. The slide member 80 has a disk portion 80*a* at its one end, a larger diameter portion 80*b* disposed adjacent to the disk portion and a smaller diameter portion 80*c* disposed at its other end, the smaller diameter portion 80*c* being inserted into the bore formed through the second half 60B of the coupling with the end face of the larger diameter portion 80*b* held in contact with the end face of the second half 60B of the coupling. With this construction, the slide member 80 is urged by the spring 74 toward the front wall 34*a* of the casing 34, and its disk portion 80*a* is normally spaced from the solenoid coil 82. And, if the solenoid coil 82 is actuated, then the slide member 80 is attracted by the solenoid coil 82 against the influence of the spring 74 to thereby bringing the second half 60B of the coupling into driving engagement with the first half 60A. Thus, by the operation of the solenoid 76 and the spring 74, the second half 60B of the coupling is engaged with or disengaged from the first half 60A.

Figure 3:
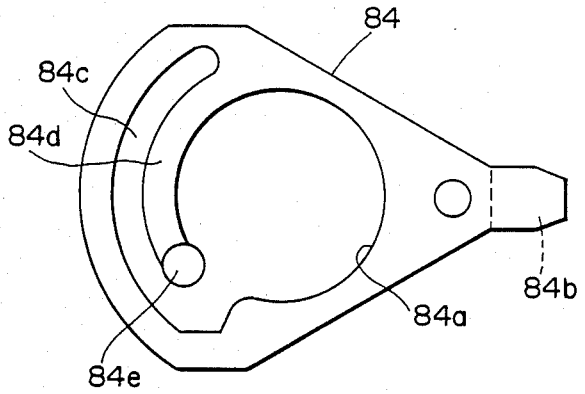
FIG. 3 is a front elevational view showing a stopper provided in the drive apparatus of FIG. 2.
Figure 4:
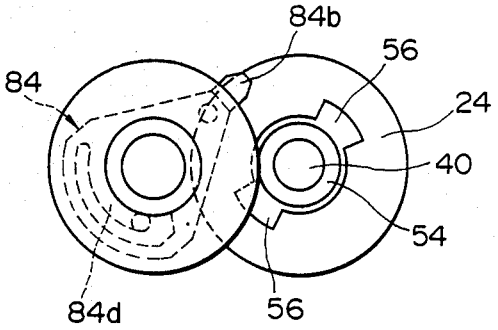
FIG. 4 is a view showing the arrangement of the stopper with respect to other elements of the drive apparatus.

Disposed between the partition wall 48 and the first half 60A of the coupling is a known stopper 84 for preventing the rotor of the motor from rotating reversely. As shown in FIG. 3, the stopper 84 comprises a generally triangular plate having a central aperture 84*a* formed therethrough and an abutment portion 84*b* formed at its apex. An arcuate aperture 84*c*, which extends from the central aperture along its periphery, is formed therethrough to define an arcuate resilient portion 84*d*, and an engaging member 84*e* is formed at the free end of the arcuate portion 84*d*. The stopper 84 is mounted on the hub portion 66 of the first half 60A of the coupling for rotation therewith, and when the rotor 42 rotates in a reverse direction, the engaging member 84*b* is brought into engagement with one of the protrusions 56, thereby preventing the reverse rotation.

Figure 5:
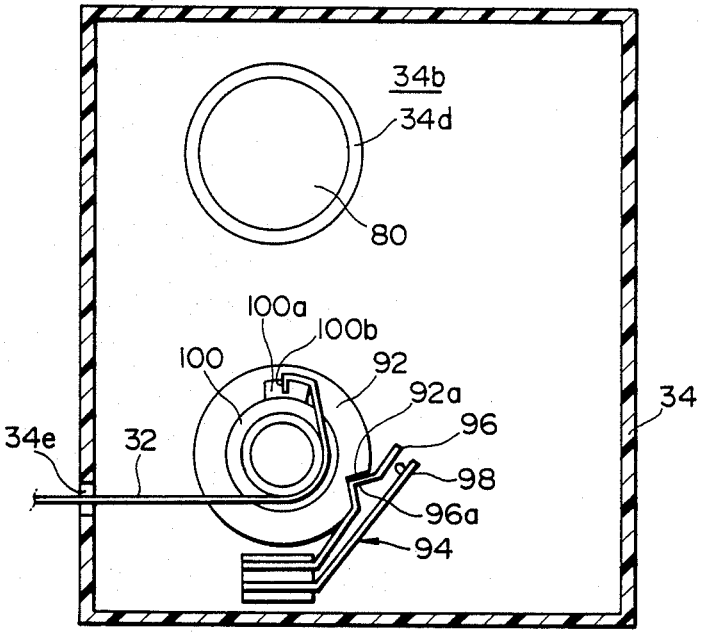
FIG. 5 is a cross sectional view taken along the line V—V of FIG. 2.

Further, a reduction gear unit 86 comprising a sequential train of gears is accommodated in the second compartment 52 of the housing 38. The gear unit comprises a first or input gear 86*a* in mesh with the gear portion 68 of the clutch 58, several intermediate gears 86*b*, and a last or output gear 86*c*. An output shaft 88, which extends through and is rotatably supported by the rear wall 34*b* of the casing 34, is secured at its one end to the partition wall 48, and the last gear 86*c* is mounted on the shaft 88 for rotation therewith. The other end portion of the output shaft 88 is disposed in the interior of the casing 34, and timer means 94 is mounted on the portion of the shaft. The timer means 94 comprises a cam 92 fixedly mounted on the portion of the shaft 88 for rotation therewith, and switch means consisting of first and second contacts 96 and 98 disposed adjacent, to the cam 92. As best shown in FIG. 5, the switch contacts are fixedly secured at their one ends to the side wall of the casing 34, respectively, so that the other free ends of the contacts are spaced from each other. The first switch contact 96 disposed nearer to the cam 92 has a bent or engagement portion 96*a* of a V-shape while the cam 92 has a cutout 92*a* formed in its outer periphery so that the bent portion 96*a* can be fitted in the cutout 92*a*. The second switch contact 98 has, a small projection protruding toward the first switch contacts at its free end. Thus, when the bent portion 96*a* of the first leaf switch 96 is fitted in the cutout 92*a* of the cam 92, the free ends of the switch contacts are caused to be spaced from each other, as shown in FIG. 5, thus turning off the switch means. On the other hand, as the cam 92 rotates, the bent portion 96*a* of the first switch contact 96 is released from the cutout 92*a* of the cam 92 to be brought into contact with its outer periphery, and therefore the first switch contacts 96 is bent toward the second switch contact 98 so that its free end is brought into contact with the projection of the second switch contact 98, thus turning on the switch means.

Also mounted on the output shaft 88 for rotation therewith is a pulley 100 which has a mounting member 100*a* having a hole 100*b* formed therein, and the wire 32 of the ventilating system, which passes through an aperture 34*e* of the casing 34, is inserted into and secured to the hole 100*b*.

Figure 6:
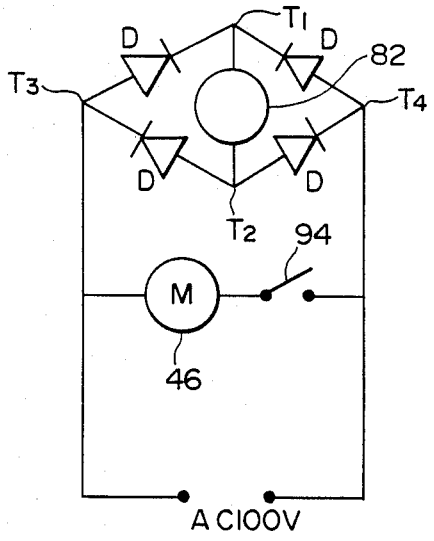
FIG. 6 is a diagram of the drive circuit of the apparatus of FIG. 2.

FIG. 6 depicts a drive electric circuit of the above drive apparatus. The solenoid coil 82 of the solenoid 76 is electrically connected to DC current terminals $T_1$ and $T_2$ of a bridge constituted by four diodes D, an a power source (AC 100 V) is electrically connected to AC current terminals $T_3$ and $T_4$ of the bridge. The coil 46 of the motor 36 is electrically connected to the power source through the switch means of the timer means 94. Although not illustrated, the fan motor 12 is electrically connected to the power source directly.

For operating the above drive apparatus, the power source is first turned on to generate an AC. current, which is rectified by the diodes D to a DC current. The DC current then actuates the solenoid coil 82 to attract the disk portion 80*a* thereto, so that the disk portion 80*a* is brought into contact with the solenoid casing 78. When the disk portion is thus moved, the second half 60B of the coupling of the clutch 58 is caused to move axially against the influence of the spring 74 toward the first half 60A of the coupling, and thus the second half 60B is engaged with the first half 60A.

Further, the switch means of the timer means 94 is initially closed. Hence the coil 46 of the motor 36 is activated, and the rotor 42 is caused to rotate in a direction designated by an arrow e in FIG. 2. When the rotor is thus caused to rotate, the first half 60A of the coupling of the clutch 58 is caused to rotate since the gear portion 64 of the first half 60A is in mesh with the gear portion 54 of the rotor. Since the first half 60A of the coupling is held in engagement with the second half 60B, as described above, the output shaft 88 is caused to rotate in a direction designated by an arrow f through the reduction gear unit 86 and the like, to thereby cause the cam 92 to rotate counterclockwise in FIG. 5. Thus, the wire 32 is wound on the pulley 100, and the connecting lever 23 is caused to move downwardly as designated by an arrow g in FIG. 1, to pivot the louvers 20 about their pins 22 clockwise to open the shutter 18.

When the shutter 18 is opened sufficiently, the cam 92 is in a position wherein the bent portion 96*a* of the first switch contact 96 approaches the cutout 92*a* of the cam 92, so that the bent portion moves into the cutout, thus turning off the switch means of the timer means 94. As a result, the rotor 42 of the motor 36 stops causing the cam to stop and, thereby stopping the shutter 18. In such a condition, the weight of the louvers 20 and the biasing force of the spring 26 are exerted on the wire 32 to cause it to move in a direction opposite to that designated by the arrow g, and thus the output shaft 88, as well as the gears of the reduction gear unit 86, is caused to rotate in an opposite direction. Since the solenoid 76 is still on, this reverse force acts on the gear portion 64 of the first half 60A of the coupling of the clutch 58 to rotate it in an opposite direction. However, when the gear portions 64 and 54 rotate in the reverse directions, the abutment portion 84*b* of the stopper 84 is brought into abutment with the projection 56, thus preventing the rotor from rotating reversely further. Accordingly, the pulley 100 is prevented from rotating further in the opposite direction, and the shutter 18 is kept in its opening position while the power source is on.

On the other hand, when the power source is off, the solenoid 76 is de-energized, and the slide member 80 is caused to move away from the solenoid under the influence of the spring 74, thereby disengaging the second half 60B of the coupling from the first half 60A. As a result, since the force exerted on the pulley 100 is released therefrom, the louvers 20 are caused to pivot counterclockwise under the influence of spring 26 and the weight of the louvers 20, and thus the shutter 18 is closed.

In the drive apparatus as described above, the opening and closing operations of the shutter 18 are initiated by the on-off operation of the power source, and the place where the ventilating system is to be mounted is not limited.

Further, inasmuch as the shutter 18 is independent of the the fan motor 12, the opening and closing of the shutter 18 can be done independently of the direction of rotation of the fan 16. Besides, it is possible to open and close the shutter without rotating the fan 16, and in such a case the ventilating system serves as a ventilating opening.

Moreover, since the drive apparatus A can be easily removed from the ventilating system, maintenance or repair of the ventilation system can be easily done.

Furthermore, since the solenoid casing 78 of the solenoid 76 is made of the magnetic material, the magnetic flux generated by the coil 82 converges and hence is effectively made use of. For this reason, the shutter 18 can be kept in its opening position with reduced consumption of electric power.

In the foregoing, the drive apparatus A may be mounted outside the framework 10 of the ventilating system. In such a case, the drive apparatus is less susceptible to breakage since it is prevented from being soiled with oil and dirt, and the maintenance of the ventilating system can be more easily conducted. Further, instead of the wire 32 and the pulley 100, another transmission mechanism making use of gears, for example, can be employed for converting the rotational movement of the output shaft 88 to the vertical movement of the connecting lever 23.

Figure 7:
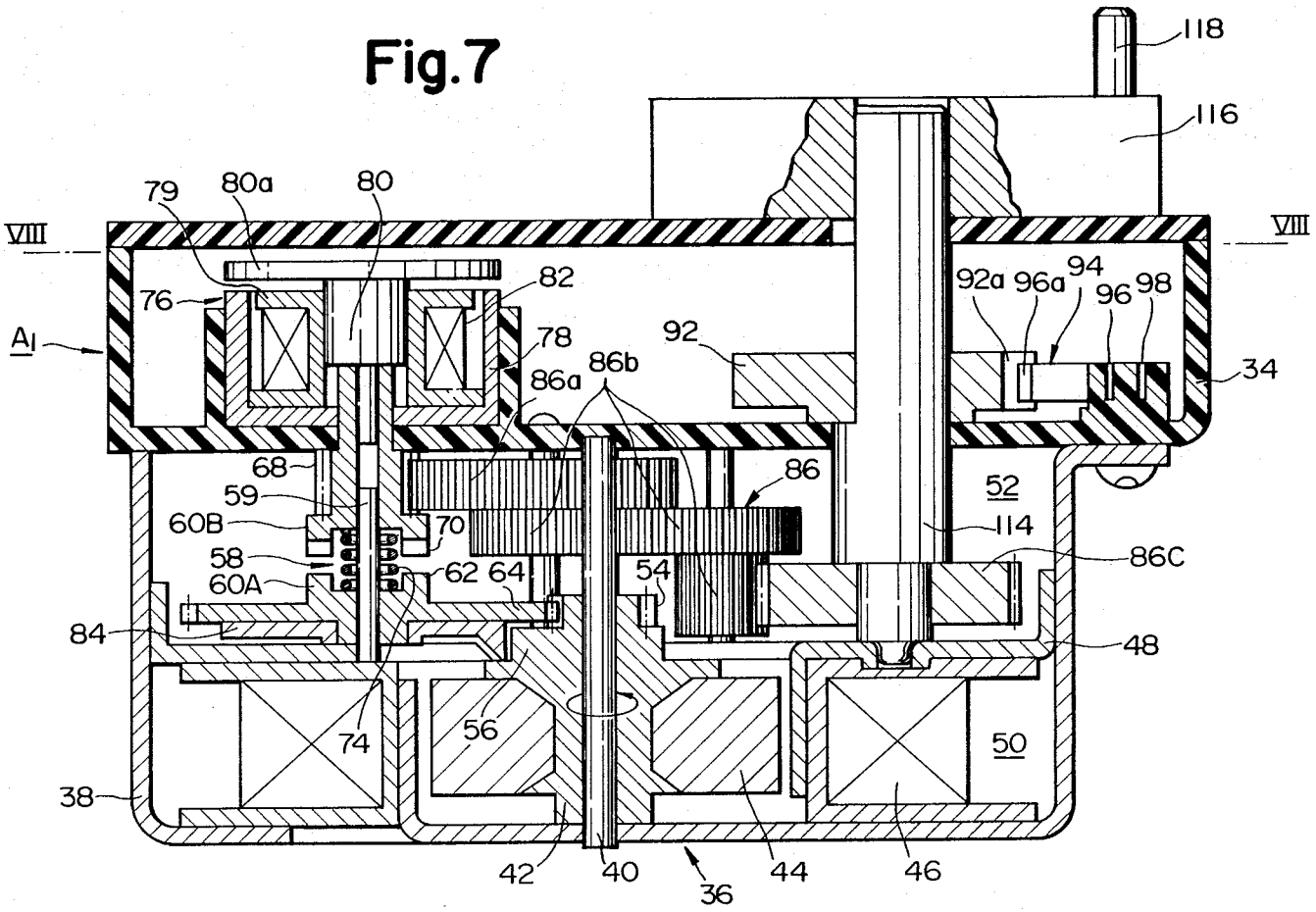
FIG. 7 is a view similar to FIG. 2, but showing a modified drive apparatus in accordance with the present invention.
Figure 8:
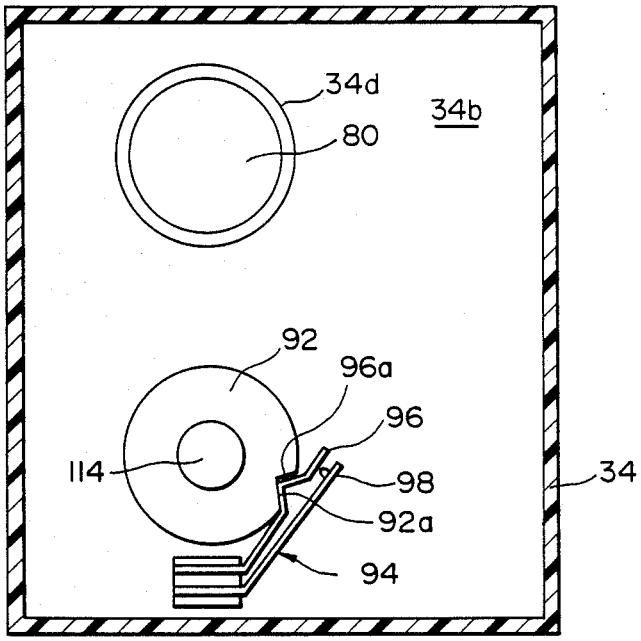
FIG. 8 is a cross sectional view taken along the line VIII—VIII of FIG. 7.
Figure 9:
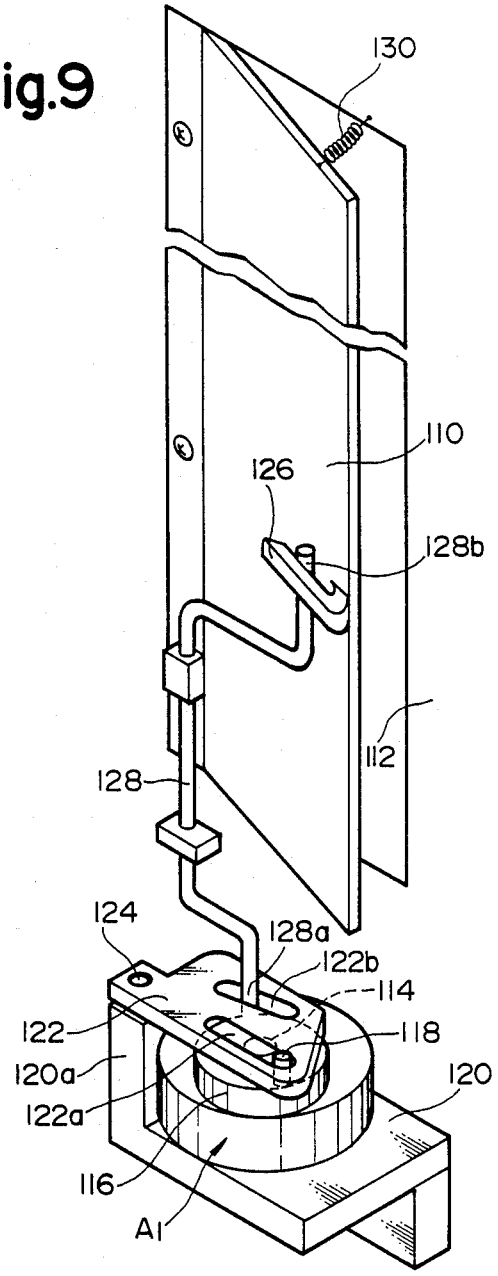
FIG. 9 is a perspective view of the apparatus of FIG. 7, the apparatus being shown together with an opening and closing mechanism.

FIGS. 7 to 9 depict a modified drive apparatus in accordance with the present invention. In this embodiment, the drive apparatus, generally designated at $A_1$, is used for operating a damper 110 which opens and closes an opening formed through a wall 112. The drive apparatus $A_1$ is basically similar to the first embodiment, but includes an output shaft 114 protruding outwardly through the casing 34. Instead of the pulley and the like, a thick circular plate 116 is mounted on the free end of the output shaft for rotation therewith with its one end face held in contact with the outer surface of the casing 34. The plate 116 has a drive rod 118 mounted on its other end face in spaced relation to the axis of the shaft, so that when the output shaft 114 is rotated, the drive rod 118 produces a circular contour coaxial with the shaft.

Further, a base 120 is fixedly secured to the wall 112 so as to be located under the opening, and the drive apparatus $A_1$ is mounted on the base with the drive rod 118 being directed upwardly. The base 120 has a standard 120*a* formed thereon at its one side margin, and a guide plate 122, which includes first and second elongated apertures 122*a* and 122*b* formed therethrough, is pivotally secured to the upper face of the standard 120*a* through a pin 124, the drive rod 118 being inserted into the first elongated aperture 122*a* for sliding movement therealong. A guide 126 is mounted on the rear face of the damper 110 so as to define a space therebetween. A connecting rod 128, which is pivotally secured to the wall 112, has one end 128*a* inserted into the second elongated aperture 122*b* of the guide plate 122 for sliding movement therealong, and the other end 128*b* inserted into the above space. Further, a coil spring 130 is connected between the damper 110 and the wall 112 to urge the damper in a closing direction.

In the above-mentioned embodiment, the damper 110 is opened and kept in its open position or closed in a manner similar to that in the previous embodiment.

Figure 10:
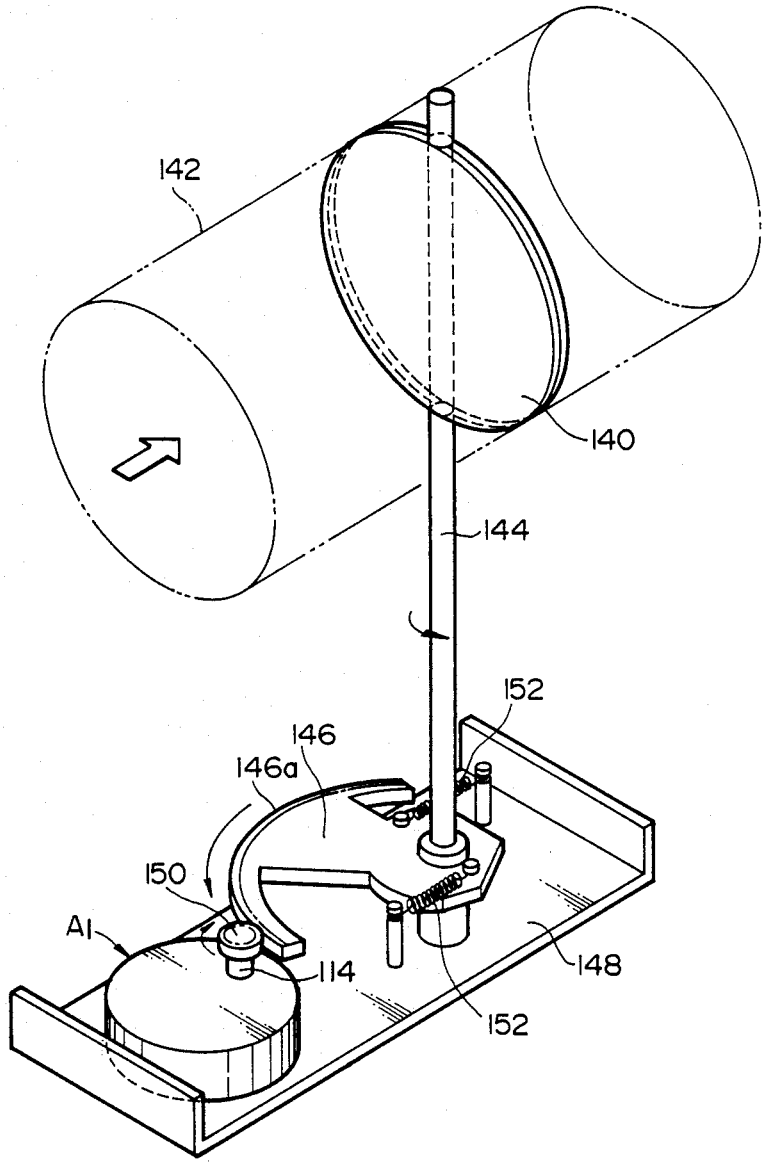
FIG. 10 is a perspective view of the apparatus of FIG. 7, the apparatus being shown together with another opening and closing mechanism.

FIG. 10 depicts another application of the drive apparatus $A_1$ of FIG. 7, in which it is utilized for operating a remote operated valve. The valve comprisss a valve disk 140 for opening and closing the passageway of pipes 142, and a valve stem 144 on which the valve disk is mounted. Fixedly mounted on the lower end of the valve stem 144 for rotation therewith is a generally sector shaped pivot plate 146 which includes a gear portion 146*a* formed on its periphery. In this embodiment, the drive apparatus $A_1$ is mounted on a base 148 disposed adjacent to the valve so that the output shaft 114 extends upwardly. A gear 150 is fixedly mounted on the output shaft 114 for rotation therewith, and the gear portion 146*a* of the pivot plate 146 is disposed in mesh with this gear 150. Further, a pair of coil springs 152 are connected between the pivot plate 146 and the base 148 for urging the valve stem 144 or the valve disk 140 to rotate so as to close the passageway of the pipes.

In this embodiment, when the solenoid is actuated to connect the clutch, the output shaft 114 is caused to rotate in a direction of an arrow in FIG. 10, and the pivot plate 146 is caused to rotate in a direction as illustrated against the biasing force of the springs 152, thus opening the valve disk 140. Then, a stop signal produced by the switch means of the timer means 94 causes the motor 36 to stop. When the solenoid is de-energized to disconnect the clutch, the engagement of the output shaft 114 is released, thus allowing the pivot plate 140 to rotate in a reverse direction under the influence of the springs 152 to close the valve disk 140.

Figure 11:
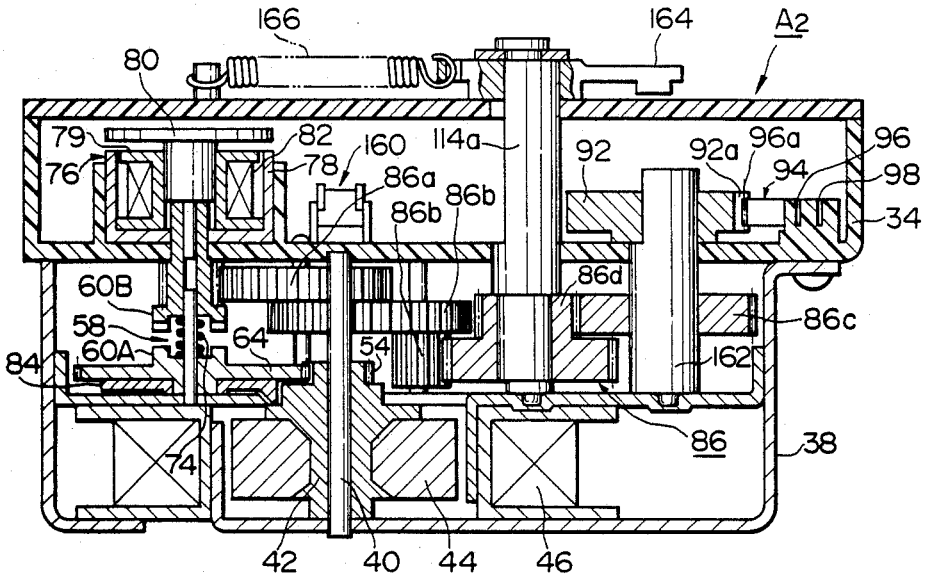
FIG. 11 is a view similar to FIG. 2, but showing a further modified drive apparatus in accordance with the present invention.
Figure 12:
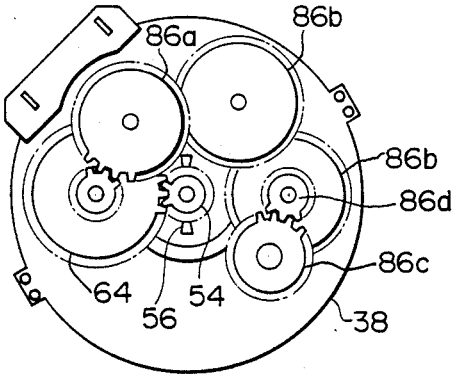
FIG. 12 is a view showing a train of reduction gears of the apparatus of FIG. 11.

FIGS. 11 and 12 depict a further modified drive apparatus $A_2$ in accordance with the present invention. In this embodiment, a rectifier 160, which converts an AC current to a DC current for being supplied to the solenoid 76, is mounted on the inner surface of the casing 34 and disposed adjacent to the solenoid 76. Further, in this embodiment, the number of the intermediate gears of the reduction gear unit 86 is greater than the previous embodiments, and the last gear 86*c* is fixedly mounted on a timer drive shaft 162 on which the cam 92 is fixedly mounted. That gear in mesh with the last gear 86*c*, designated at 86*d*, and the gear coaxially integral with this gear 86*d* are fixedly secured on an output shaft 114*a*. In this embodiment, fixedly mounted on the protruding end of the output shaft 114*a* for rotation therewith is a lever 164 which is operatively connected to a switching or opening and closing mechanism such as a damper through a suitable transmission mechanism. A coil spring 166 is connected between the lever 164 and the casing 34 to bias the lever 164 to rotate to its original position.

In the above embodiment, the reduction gear unit is constituted so that the rotational speed is gradually reduced from the first gear to the last one, and therefore the timer drive shaft 162 has a reduced speed than the output shaft 114*a*. Although the rotation of the timer drive shaft 162 is limited lest it exceeds 360° due to the provision of the timer means 94, the output shaft 114*a* is allowed to rotate more than 360° or a plurality of revolutions, thus permitting the opening and closing mechanism such as damper to have a greater rotational angle.

Further, the rotational angle or distance of the opening and closing mechanism can be changed arbitrarily by modifying the reduction ratio of the last gear relative to the first gear, and the angular position of the cam relative to the timer drive shaft, i.e., the circumferential position of the cutout of the cam relative to the switch means.

Figure 13:
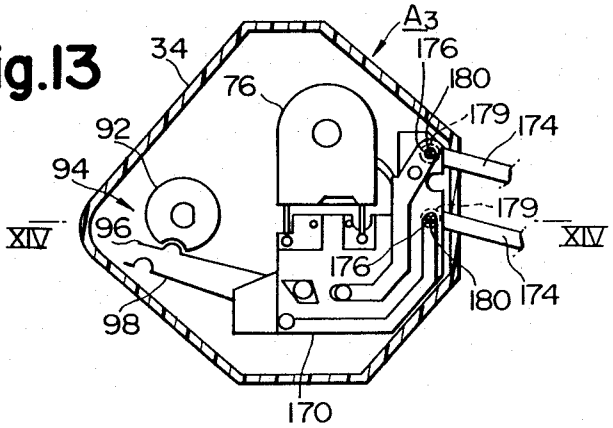
FIG. 13 is a cross sectional view showing a further modified drive apparatus in accordance with the present invention.
Figure 14:
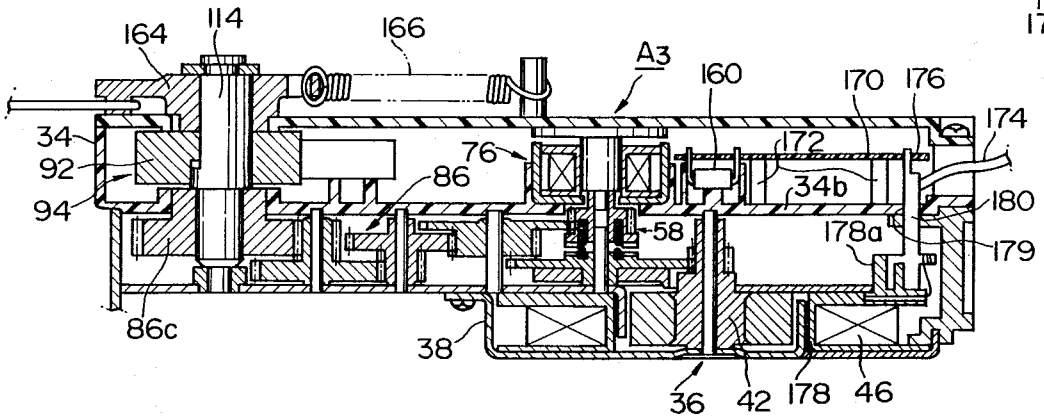
FIG. 14 is a view similar to FIG. 2, but showing a cross sectional view taken along the line XIV—XIV of FIG. 13.

FIGS. 13 and 14 depict a further modified drive apparatus $A_3$ in accordance with the present invention. In this embodiment, a printed circuit board 170 for the switches 96 and 98 is provided in the interior of the casing 34. The board 170 is supported by standards 172 adhered to the inner surface of the rear wall 34*b* of the casing 34 so as to be parallel to it. Electrically connected to the printed circuit of the circuit board 170 directly are the two leads 174 and the two leaf switches 96 and 98 of the switch means of the timer means, and the circuit board 170 includes two slits 176 formed therein. A mounting portion 178*a* is integrally formed on an outer periphery of a bobbin 178 for receiving the stator coil 46 of the motor 36, and two leaf terminals 180 are fixedly secured at their one ends to the mounting portion 178*a*. Each terminal 180 is made of a suitable magnetic material so as to have a sufficient rigidity, and disposed so as to extend upwardly through a respective aperture 179 in the rear wall 34*b* of the casing 34. The other end of each terminal 180 is formed so as to have a reduced thickness, and inserted into a respective one of the slits of the board 170 and secured to the circuit of the board by soldering. As shown in FIG. 14, disposed and electrically connected between the solenoid 76 and the circuit of the board 770 is the rectifier 160 which comprises the four diodes.

In this embodiment, the motor coil 46 is electrically connected to the circuit board 170 through the terminals 180, and therefore it is not required to connect the switch means of the timer means 94 and the motor coil 46 through leads. Accordingly, it is easy to assembly the device, and besides the number of parts or elements can be reduced substantially, resulting in a simple structure. Further, since the motor coil and the switch means of the timer means are connected by connecting means disposed within the casings, an open circuit or any trouble in their connection can be definitely prevented.

For assembling the device, the circuit board 170 is first secured to the standards by adhesion, and then the casing 34 is mounted on the motor housing while the terminals 180 are inserted through the apertures 179. Thus, the ends of the terminals 180 can be automatically inserted into the slits of the board 170. The board, however, may be secured to the standards after the casing is mounted on the motor housing.

Obviously many modifications and variations of the present invention are possible in the light of the above teachings. It is therefore to be understood that within the scope of the appended claims, the invention may be practiced otherwise than as specifically described.

What is claimed is:

1. A drive apparatus for driving an opening and closing mechanism, comprising:

an electric motor having a rotor;

clutch means comprising a coupling having first and second halves engageable with each other, and actuator means for connecting and disconnecting said first and second halves, said first half of the coupling being operatively connected to said rotor;

reduction gear means operatively connected to said second half of the coupling of said clutch means said reduction gear means having an output shaft for being operatively connected to the opening and closing mechanism so as to rotate in different directions for the opening and closing operations of the mechanism, respectively; and timer means operable to regulate the operating period of time of said motor in response to the operation of said reduction gear means, and including (i) a control switch to selectively connect the motor to an electric power source to actuate the motor, and (ii) a cam mounted on the output shaft, adjacent the control switch, to open said control switch and deactuate the motor when said output shaft reaches a selected position.

2. A drive apparatus according to claim 1, wherein said cam is fixedly mounted on said output shaft for rotation therewith and said control switch comprises and a pair of switch contacts disposed adjacent to said cam, said cam having a cutout formed in its outer periphery, each of said switch contacts having one end for being electrically connected to a drive circuit for working the drive apparatus, one of said switch contacts having at its other end an engagement portion to fit in said cutout of said cam, said pair of switch contacts being positioned so that when said engagement portion is fitted in said cutout of said cam, the other ends of the switch contacts are spaced from each other while when said engagement portion is released from said cutout of said cam, the other ends of the switch contacts are brought into contact with each other.

3. A drive apparatus according to claim 1, in which said actuator means comprises urging means interposed between said first and second halves to urge said first and second halves to move away from each other, and an actuator operable to bring said first and second halves into driving engagement with each other.

4. A drive apparatus according to claim 3, in which said urging means is a compression spring, and said actuator is a solenoid.

5. A drive apparatus according to claim 4, further comprising a casing defined by front and rear walls and side wall joining said front and rear walls, said motor comprising a motor housing having an open end and mounted on an outer surface of said rear wall with the open end being held in contact with said outer surface, said reduction gear means and said coupling of said clutch means being housed within said motor housing while said solenoid and said timer means are housed within said casing.

6. A drive apparatus according to claim 1, further comprising biasing means for urging said output shaft to angularly move on the direction for the closing operation of the mechanism.

7. A drive apparatus according to claim 6, further comprising stopper means for preventing said output shaft from angularly moving in the direction for the closing operation of the mechanism.

8. A drive apparatus for driving an opening and closing mechanism, comprising:

an electric motor having a rotor;

clutch means comprising a coupling having first and second halves engageable with each other, and actuator means for connecting and disconnecting said first and second halves, said first half of the coupling being operatively connected to said rotor;

reduction gear means operatively connected to said second half of the coupling of said clutch means, said reduction gear means having an output shaft for being operatively connected to the opening and closing mechanism so as to rotate in different directions for the opening and closing operations of the mechanism, respectively, said reduction gear means further including a timer shaft and a sequential train of gears consisting of a first gear, intermediate gears and a last gear with gradually decreasing rotational speeds so that the last gear has the most reduced rotational speed, said first gear being operatively connected to said second half of the clutch means, one of said intermediate gears being fixedly mounted on said output shaft for rotation therewith, said last gear being fixedly mounted on said timer shaft; and timer means operable to require to regulate the operating period of time of said motor in response to the operation of said reduction gear means, and comprising (i) a cam fixedly mounted on said timer shaft for rotation therewith, said cam having a cutout, and (ii) a pair of switch contacts having one end for being electrically connected to a drive circuit for working the drive apparatus, one of said switch contacts having at its other end an engagement portion to fit in said cutout of said cam, said pair of switch contacts being positioned so that when said engagement portion is fitted in said cutout of said cam, the other ends of the switch contacts are spaced from each other, while when said engagement portion is released from said cutout of said cam, the other ends of the switch contacts are brought into contact with each other.

9. A drive apparatus for driving an opening and closing mechanism comprising:

an electric motor having a rotor;

clutch means comprising a coupling having first and second halves engageable with each other, and actuator means for connecting and disconnecting said first and second halves, said first half of the coupling being operatively connected to said rotor;

reduction gear means operatively connected to said second half of the coupling of said clutch means, said reduction gear means having an output shaft for being operatively connected to the opening and closing mechanism so as to rotate in different directions for the opening and closing operations of the mechanism, respectively;

a solenoid operable to bring said first and second halves into a driving engagement with each other;

timer means operable to regulate the operating period of time of said motor in response to the operation of said reduction gear means;

a casing defined by front and rear walls and a side wall adjoining said front and rear walls, said motor comprising a motor housing having an open end and mounted on an outer surface of said rear wall with an open end being held in contact with said outer surface, said reduction gear means and said coupling of said clutch means being housed within said motor housing while said solenoid and said timer means are housed within said casing;

a printed circuit board having an electric circuit adapted to serve as a part of a drive circuit for working the drive apparatus, and elongated terminal means having opposite ends, said circuit board being disposed in said casing, wherein said timer means includes a pair of switch contacts electrically connected to the circuit of said circuit board, said motor comprising a motor coil, said terminal means extending through said rear wall of said casing, one end of said terminal means being electrically connected to said motor coil while the other end is electrically connected to said circuit of said circuit board.

* * * * *